US005284733A

United States Patent [19]

Kojima et al.

[11] Patent Number: 5,284,733

[45] Date of Patent: Feb. 8, 1994

[54] HIGH-CONTRAST IMAGE FORMING PROCESS

[75] Inventors: Yasuhiko Kojima, Saitama; Naoki Obi, Tokyo; Yasuo Shigemitsu, Saitama; Kiyoshi Suematsu, Tokyo, all of Japan

[73] Assignee: Dainippon Ink and Chemicals, Inc., Tokyo, Japan

[21] Appl. No.: 769,285

[22] Filed: Oct. 1, 1991

[30] Foreign Application Priority Data

Oct. 3, 1990 [JP] Japan ..... 2-263926
Apr. 11, 1991 [JP] Japan ..... 3-078991

[51] Int. Cl.[5] ..... G03C 1/04

[52] U.S. Cl. ..... 430/265; 430/264; 430/435; 430/436; 430/440; 430/444; 430/627; 430/630

[58] Field of Search ..... 430/264, 627, 265, 266, 430/267, 435, 436, 440, 444, 480, 485, 268, 630

[56] References Cited

U.S. PATENT DOCUMENTS 3,370,048 2/1968 Reynolds .
3,518,085 6/1970 Milton et al. ..... 430/627
4,997,743 3/1991 Sasaoka et al. ..... 430/264

FOREIGN PATENT DOCUMENTS 1595568 4/1970 Fed. Rep. of Germany .
2715315 10/1977 Fed. Rep. of Germany .
1518782 7/1978 United Kingdom .

OTHER PUBLICATIONS

Chemical Abstracts, Abstract No. 184960M, vol. 99, p. 593, Columbus, Ohio, Nov. 1983 of SU1,024,461, Jun., 1983.

*Primary Examiner*—Charles L. Bowers, Jr.
*Assistant Examiner*—John A. McPherson
*Attorney, Agent, or Firm*—Armstrong, Westerman, Hattori, McLeland & Naughton

[57] ABSTRACT

A silver halide photographic material is disclosed. The photographic material comprises a support having coated thereon one or more hydrophilic colloidal layers, at least one of the hydrophilic colloidal layers being a negative working silver halide emulsion layer, wherein said silver halide emulsion layer or another hydrophilic colloidal layer contains a water-soluble polymer or copolymer having a quaternary ammonium salt in a repeating unit. The process for forming a high contrast negative image using the photographic material is also disclosed.

8 Claims, No Drawings

HIGH-CONTRAST IMAGE FORMING PROCESS

FIELD OF THE INVENTION

The present invention relates to a silver halide photographic material and a process for forming photographic images using the silver halide photographic material. More particularly, the present invention relates to a silver halide photographic material for forming negative images which is useful for the step of a photomechanical process for graphic art printing and has a very high contrast.

BACKGROUND OF THE INVENTION

Since in a step of photomechanical process, the formation of sharp dot images or line images is required, an image-forming system requires very high contrast photographic characteristics (in particular, gamma of at least 10). Hitherto, for this purpose, a process of processing a lith-type silver halide photographic material comprising a silver chlorobromide emulsion having a silver chloride content of over 50 mol %, and more preferably over 70 mol % with a specific developer called a "lithographic developer" containing only hydroquinone as a developing agent and having a very low free sulfite ion concentration (usually not more than 0.1 mol/liter) has been used. However, since for a lith-type silver halide photographic emulsion, a silver chlorobromide having a high silver chloride content must be used, it is difficult to attain a high sensitivity.

As other processes of obtaining high contrast negative images, there are processes using specific hydrazine derivatives disclosed in U.S. Pat. Nos. 4,168,977, 4,224,401, 4,241,164, 4,269,929, 4,311,781, 4,650,746, etc. According to these processes, by processing a surface latent image-type silver halide photographic material containing a specific hydrazine derivative (generally, an acylphenylhydrazine derivative) as a nucleating agent with a developer having pH of from 11.0 to 12.3, photographic characteristics having a superhigh contrast of gamma over 10 and a high sensitivity are obtained. Since in these processes, a silver bromide emulsion or a silver chlorobromide emulsion having a high silver bromide content can be used, a high sensitivity can be achieved as compared to the case of using lith-type silver halide emulsion.

However, it has been found that the foregoing high contrast image-forming system using the hydrazine derivative has various defects. That is, when the foregoing image-forming system is used, high contrast negative images are obtained but, at the same time, it is accompanied by the formation of pepper (black pepper), which becomes a large problem for a photomechanical process. The pepper in photography means black sesame-like spots occurring in an unexposed area, for example, an area to become an undeveloped area between a dot and a dot. The appearance of the pepper causes the trouble of greatly reducing the commercial value as a photographic light-sensitive material for a photomechanical process. Accordingly, various efforts have been made for the development of a pepper restraining technique, but the improvement in pepper susceptibility is frequently accompanied by the reduction of the sensitivity and gamma. Hence, it has been strongly desired to develop an image forming system capable of obtaining a high sensitivity and high contrast without being accompanied by the appearance of the pepper.

On the other hand, for the purpose of improving photographic performance, the technique of incorporating a certain kind of a quaternary ammonium salt polymer in a silver halide photographic material as a silver halide photographic element is disclosed in JP-A-62-9346, JP-A-62-215949, JP-A-63-13034, JP-A-1-280749, JP-A-2-144533, JP-A-2-308160, JP-A-3-36544, and JP-A-3-38637 (the term "JP-A" as used herein means an "unexamined published Japanese patent application"), European Patents 320,692 and 398,223, U.S. Pat. No. 4,914,018, etc., for static prevention, in JP-A-63-249839, JP-A-2-212834, etc., for the improvement of tone, in JP-A-2-68545 and European Patent 306,246, etc., for the improvement of image sharpness, in JP-B-55-39821 (the term "JP-B" as used herein means an "examined Japanese patent publication"), JP-A-60-122942, JP-A-3-27036, etc., for the improvement of photographic characteristics, and in JP-A-1-150130 for the improvement of the performance and the physical properties.

However, it has never been known that by adding a quaternary ammonium salt polymer to silver halide photographic material and processing the photographic material with a specific developer, the sensitivity is greatly increased and also the contrast is greatly increased, whereby negative images of a very high contrast over 10 in gamma can be obtained.

SUMMARY OF THE INVENTION

The object of this invention is to provide a silver halide photographic material capable of giving good negative images of a high sensitivity and a very high contrast without accompanied by the appearance of pepper by processing the photographic material with an aqueous alkaline developer after imagewise exposure and also to provide a process for forming negative images having a high sensitivity and a high contrast useful for a photomechanical process in graphic art printing.

It has now been discovered that the above object of this invention can be achieved by the present invention as described hereinbelow.

That is, according to the first embodiment of this invention, there is provided a silver halide photographic material comprising a support having coated thereon one or more hydrophilic colloidal layers, at least one of the hydrophilic colloidal layers being a negative working silver halide emulsion layer, wherein said silver halide emulsion layer or another hydrophilic colloidal layer contains a water-soluble polymer or copolymer having a quaternary ammonium salt in a repeating unit.

Also, according to the second embodiment of this invention, there is provided a process for forming a high contrast negative image, which comprises processing, after imagewise exposing, a silver halide photographic material comprising a support having coated thereon one or more hydrophilic colloidal layers, at least one of the hydrophilic colloidal layers being a silver halide emulsion layer, said silver halide emulsion layer or another hydrophilic colloidal layer containing a water-soluble polymer or copolymer having a quaternary ammonium salt in a repeating unit, with an aqueous alkaline developer.

DETAILED DESCRIPTION OF THE INVENTION

As the water-soluble polymer or copolymer having a quaternary ammonium salt in a repeating unit for use in this invention, there are preferred water-soluble polymers and copolymers having at least one kind of repeating units represented by formulae (I), (II), (III), and (IV)

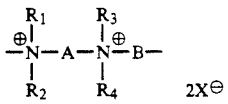

(I)

wherein A represents an alkylene group having from 1 to 6 carbon atoms, $-CH_2-CH=CH-CH_2-$, or $-CH_2-C\equiv C-CH_2-$; B represents an alkylene group having from 1 to 6 carbon atoms, a p-xylylene group, each $-CH_2-CH=CH-CH_2-$, or $-CH_2-C\equiv C-CH_2-$; $R_1$, $R_2$, $R_3$, $R_4$, each independently represents a lower alkyl group having from 1 to 4 carbon atoms; and $X^-$ represents an anion:

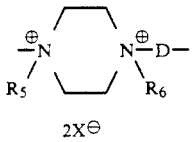

(II)

wherein D represents an alkylene group having from 1 to 6 carbon atoms, $-CH_2-CH=CH-CH_2-$, or $-CH_2-C\equiv C-CH_2-$; $R_5$ and $R_6$ each independently represents a lower alkyl group having from 1 to 4 carbon atoms, provided that $R_5$ and $R_6$ may be combined with each other to form an ethylene group; and $X^-$ represents an anion:

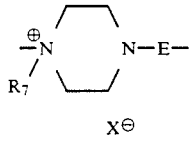

(III)

wherein E represents an alkylene group having from 1 to 6 carbon atoms, $-CH_2-CH=CH-CH_2-$, or $-CH_2-C\equiv C-CH_2-$; $R_7$ represents a lower alkyl group having from 1 to 4 carbon atoms; and $X^-$ represents an anion:

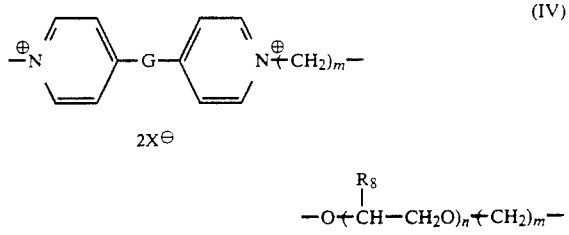

(IV)

wherein G represents an alkylene group having from 1 to 8 carbon atoms; $R_8$ represents a hydrogen atom or a methyl group; m represents an integer of from 1 to 4; n represents an integer of from 1 to 12; and $X^-$ represents an anion.

Examples of the preferred alkylene group shown by A, B, D, E, and G in formulae (I), (II), (III), and (IV), respectively, are a methylene group, an ethylene group, a trimethylene group, a tetramethylene group, a pentamethylene group, and a hexamethylene group. The particularly preferred alkylene group in this invention are a trimethylene group, a tetramethylene group, and a pentamethylene group.

Also, examples of the lower alkyl group shown by $R_1$, $R_2$, $R_3$, $R_4$, $R_5$, $R_6$, and $R_7$ in formulae (I), (II), and (III) are a methyl group, an ethyl group, a propyl group, an isopropyl group, a butyl group, and an isobutyl group. Furthermore, preferred examples of the anion shown by $X^-$ in formulae (I), (II), (III), and (IV) are halide ions (e.g., an iodide ion, a bromide ion, and a chloride ion), perchlorate ions, methylsulfate ions, and p-toluenesulfonate ions.

The copolymer having the quaternary ammonium salt represented by formula (I), (II), (III) or (IV) described above as a repeating unit, which is preferably used in this invention may contain different lower alkyl groups or different divalent organic groups in one copolymer.

The weight-average molecular weight of the quaternary ammonium salt polymer or copolymer for use in this invention is preferably from 1,000 to 100,000, and particularly preferably from 2,000 to 30,000. Also, the quaternary ammonium salt polymer or copolymer may be used singly or as a combination of two or more kinds of the polymers each having a different composition may be used together.

Preferred examples of the polymers or copolymers having the quaternary ammonium salt represented by formula (I), (II), (III), or (IV) as the repeating unit are illustrated below but the present invention is not limited to these polymers.

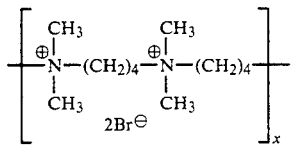

P-1

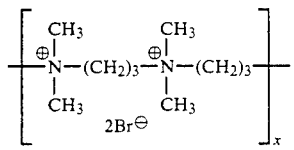

P-2

-continued
P-3
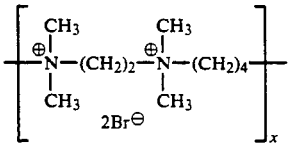
P-4
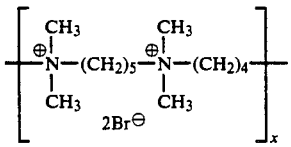
P-5
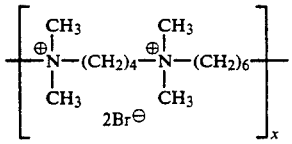
P-6
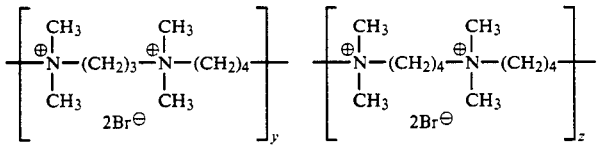
y:z = 1:1
P-7
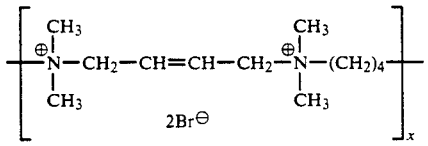
P-8
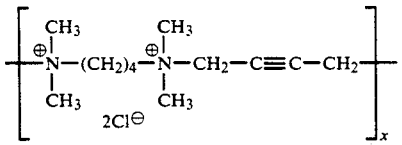
P-9
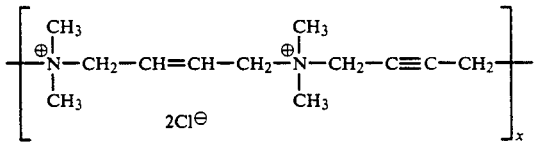
P-10
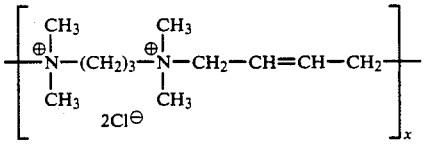
P-11
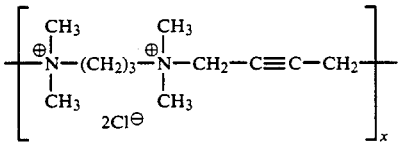

-continued
P-12
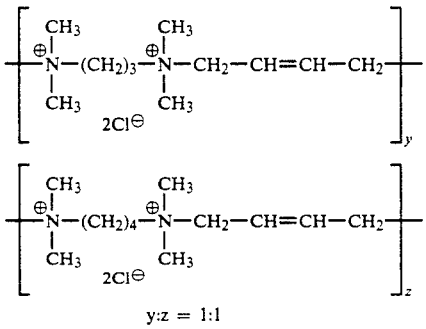
y:z = 1:1
P-13
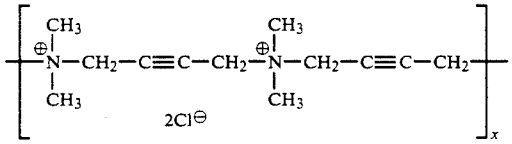
P-14
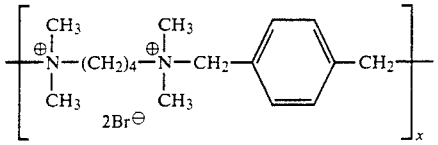
P-15
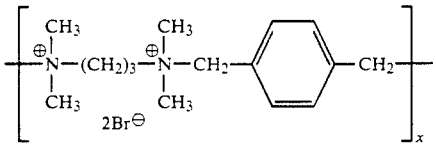
P-16
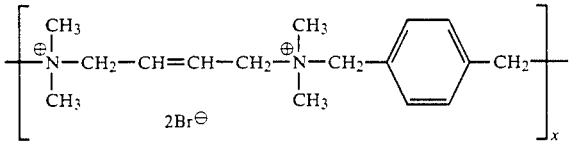
P-17
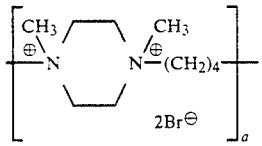
P-18
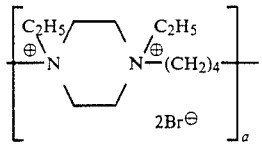
P-19
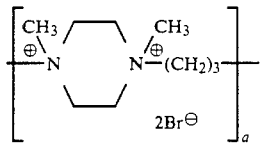
P-20
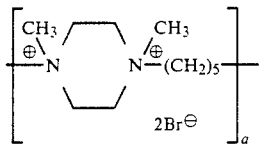

-continued
P-21
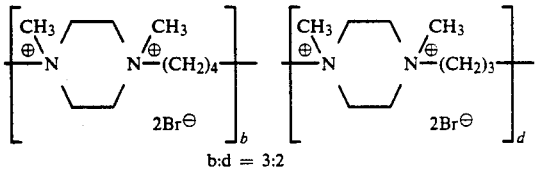
b:d = 3:2
P-22
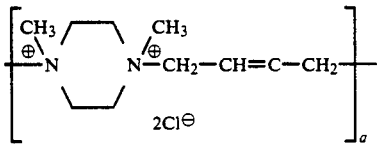
P-23
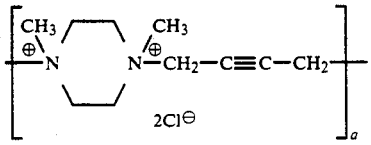
P-24
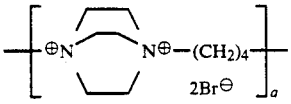
P-25
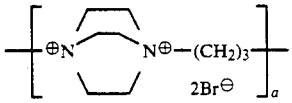
P-26
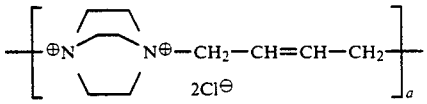
P-27
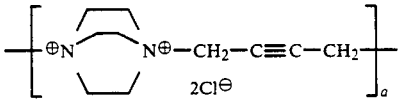
P-28
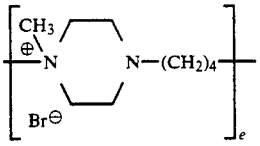
P-29
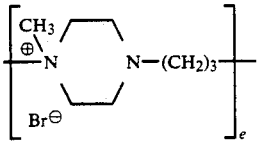
P-30
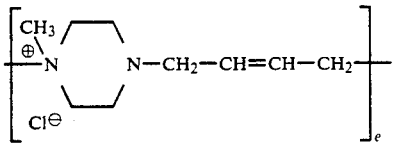

-continued

P-31

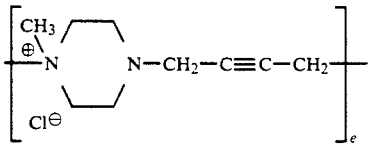

P-32

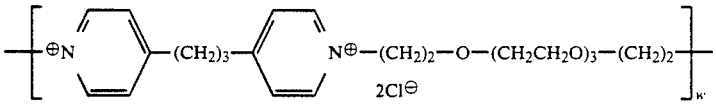

P-33

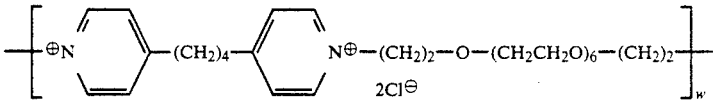

P-34

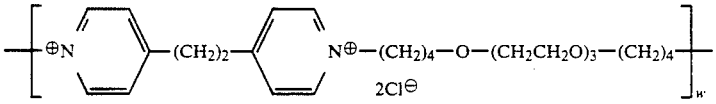

P-35

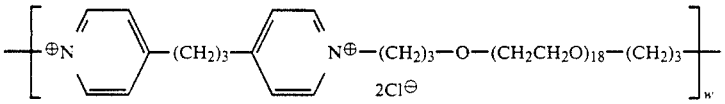

P-36

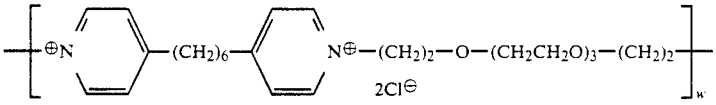

P-37

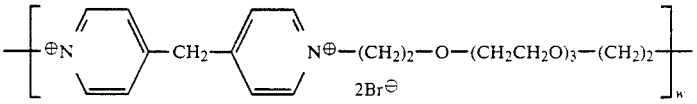

P-38

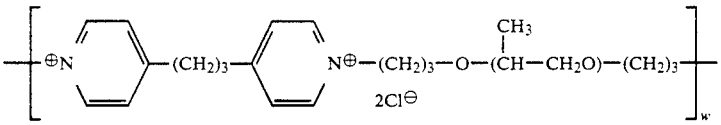

As a process of preparing the polymer or copolymer having the quaternary ammonium salt represented by formula (I), (II), (III) or (IV) as a repeating unit, which can be preferably used in this invention, there is a process of reacting an N,N,N',N',-tetraalkylalkylenediamine and an $\alpha$, $\epsilon$-dihalogen compound in an organic solvent. According to the process, desired polymers or copolymers having various polymerization degree and compositions can be prepared depending on the kind and the amount of an organic solvent, the kind and the amount of the alkylenediamine, the kind and the amount of the $\alpha,\epsilon$-dihalogen compound and/or the composition ratio of the dihalogen compound to the alkylenediamine. Specific examples of the organic solvent include ethanol, acetonitrile, tetrahydrofuran, dioxane, methyl ethyl ketone, n-hexane, dimethylformaldehyde, etc.

For incorporating the quaternary ammonium salt polymer or copolymer for use in this invention in a silver halide photographic material, the polymer or copolymer may be added to a silver halide emulsion layer or other light-insensitive hydrophilic colloidal layers such as a protective layer, an interlayer, an antihalation layer, a filter layer, etc. It is preferred that the polymer or copolymer is added to the silver halide emulsion layer.

Also, the quaternary ammonium salt polymer or copolymer being used in this invention is a compound capable of being easily dissolved in water. For incorporating the polymer or copolymer in the silver halide photographic material, the polymer or copolymer may be added to the silver halide emulsion layer or other light-insensitive hydrophilic colloidal layers as a solution thereof dissolved in water.

The addition amount of the quaternary ammonium salt polymer or copolymer for use in this invention to the silver halide photographic material is in the range of from 0.1 g to 20 g, and preferably from 2 g to 10 g per mol of silver halide contained in the photographic material. Also, the polymer or copolymer may be added to the silver halide photographic material at any desired step during the production of the photographic light-sensitive material. For example, in the case of adding it to the silver halide emulsion layer, it is preferable that the polymer or copolymer is added at any desired step after finishing chemical ripening and before coating the, emulsion.

Next, the silver halide photographic material which is used for the image-forming process of this invention is explained.

The silver halide photographic material for use in this invention has at least one silver halide photographic emulsion layer composed of a negative working silver halide emulsion. There is no particular restriction on the halogen composition of the silver halide emulsion being used and, for example, silver chloride, silver chlorobromide, silver iodobromide, or silver iodobromochloride can be used. It is preferred that the content of silver iodide in the silver halide emulsion is not more than 5 mol %, and particularly not more than 3 mol %.

The silver halide grains for use in this invention can have a relatively broad grain size distribution but preferably have a narrow grain size distribution. It is particularly preferred that the silver halide emulsion is a monodispersed emulsion composed of silver halide grains wherein the grain sizes of 90% of the total grains are within ±40% of the mean grain size.

The mean grain size of the silver halide grains for use in this invention is preferably not larger than 0.7 μm, and particularly preferably not larger than 0.4 μm. Also, the silver halide grains can have a regular crystal form such as cubic, octahedral, etc., or may have an irregular crystal form such as spherical, tabular, rounded wedge shape form, etc.

The silver halide emulsion for use in this invention can be prepared by any known method. That is, the silver halide emulsion can be prepared by an acidic method, a neutral method, an ammoniacal method, etc., and as a mixing process for a soluble silver salt and a soluble halide, a single jet process, a double jet process, a reverse mixing process, or a combination thereof can be used. As one of the double jet processes, when a so-called pAg controlled double jet process (C.D.J. process), that is a method of keeping a silver ion concentration (pAg) constant in the liquid phase during precipitating silver halide crystals is used, a monodispersed silver halide emulsion composed of silver halide grains having a uniform crystal form and having almost uniform grain size can be obtained.

In the step of the formation (precipitation) of silver halide grains or physical ripening thereof, a cadmium salt, an iridium salt, or a rhodium salt can exist in the system for increasing the contrast of the silver halide emulsion.

It is preferred that the content of the binder contained in the silver halide photographic emulsion layer in this invention is not over 250 g per mol of silver halide.

As the binder, gelatin is most preferably used but other hydrophilic colloids can be also used. For example, hydrophilic polymers such as albumin, casein, graft polymers of gelatin and other polymers, polyvinyl alcohol, polyacrylamide, etc., can be used.

The silver halide emulsion for use in this invention may not be chemically sensitized, but is usually chemically sensitized. As the chemical sensitization, a sulfur sensitization, a reduction sensitization, a noble metal sensitization or a combination thereof can be used. A particularly preferred chemical sensitization for the practice of this invention is a sulfur sensitization or a combination of a sulfur sensitization and a gold sensitization which is one of the noble metal sensitization.

For the sulfur sensitization, active gelatin, thiosulfate, thiourea, allylthiocarbamide, etc., can be used. For the gold sensitization, $HAuCl_4$, $Au(SCN)_2^-$ salt, or $Au(S_2O_3)_2^{3-}$ salt can be used.

The silver halide emulsion for use in this invention may be spectrally sensitized using one or more kinds of sensitizing dyes for giving spectral sensitivity in a desired wavelength region. As the sensitizing dye, cyanine dyes, merocyanine dyes, styryl dyes, hemicyanine dyes, holopolar cyanine dyes, oxonol dyes, hemioxonol dyes, etc., can be used. Particularly useful dyes are cyanine dyes and merocyanine dyes.

As basic heterocyclic nuclei of the dyes, nuclei usually utilized for cyanine dyes can be applied. That is, pyrroline nuclei, oxazole nuclei, oxazoline nuclei, thiazole nuclei, thiazoline nuclei, pyrrole nuclei, selenazole nuclei, imidazole nuclei, tetrazole nuclei, pyridine nuclei, indole nuclei, benzoxazole nuclei, benzthiazole nuclei, benzoselenazole nuclei, benzimidazole nuclei, quinoline nuclei, etc., can be used.

The silver halide photographic material for use in this invention comprises at least one hydrophilic colloidal layer containing a negative type silver halide emulsion coated on a support and, if necessary, one or more light-insensitive hydrophilic colloidal layers such as a protective layer, an interlayer, an antihalation layer, a filter layer, etc., may be coated thereon. These hydrophilic colloidal layers contain an inorganic or organic hardening agent. As the hardening agent, chromium salts (e.g., chromium alum), aldehydes (e.g., formaldehyde and glyoxal), N-methylol compounds e.g., dimethylolurea and methylol dimethylhydantoin), active halogen compounds(e.g., 2,4-dichloro-6-hyiroxy-s-triazine,mucochloric acid), active vinyl compounds (e.g., 1,3,5-triacryloylhexahydro-5-triazine), epoxy hardening agents, and aziridine hardening agents can be used.

For the silver halide emulsion and other light-insensitive hydrophilic colloidal layers in this invention, if necessary, various kinds of photographic additives such as emulsion stabilizers (e.g., hydroxy-tetraazaindene compounds such as 6-hydroxy-4-methyl-1,3,3*a*,7-tetraazaindene, etc.), spreading agents (e.g., saponin), gelatin plasticizers (e.g., a copolymer of acrylic acid ester), various kinds of surfactants (e.g., cationic, anionic, nonionic, and amphoteric surfactants) for various purposes such as anti-static function, coating aid, and the improvement of photographic characteristics (e.g., development acceleration and the increase of contrast), matting agents, water-insoluble or sparingly water-soluble polymer latexes (e.g., the homo or copolymers of an alkyl acrylate, alkyl methacrylate, acrylic acid, glycidyl acrylate, etc.) for improving the dimensional stability of the photographic light-sensitive material can be used in the range so that the effects of the present invention are not reduced.

As a developer for obtaining high contrast negative images by processing the silver halide photographic material of this invention, after imagewise exposure, an aqueous alkaline developer is used. As the aqueous alkaline developer, (1) a developer containing a dihydroxybenzene derivative developing agent or (2) a developer containing an aminophenol derivative developing agent and a reductone compound or a salt thereof is preferably used.

The developer (1) containing a dihydroxybenzene derivative developing agent for use in this invention is a developer containing substantially a dihydroxybenzene only as the developing agent and as the developing agent, there are, for example, hydroquinone, chlorohydroquinone, bromohydroquinone, isopropylhydroquinone, methylhydroquinone, 2,3-dichlorohydroquinone, and 2,5-dimethylhydroquinone. Among these dihydroxybenzenes, hydroquinone is preferably used practically. The foregoing developing agents may be used singly or as a mixture thereof. The amount of the developing agent is from 5 g to 100 g, and preferably from 15 g to 80 g per liter of the developer.

The foregoing dihydroxybenzene derivative developer contains substantially a dihydroxybenzene only as the developing agent as described above but the developer may contain, if desired, a 3-pyrazolidone (e.g., 1-phenyl-3-pyrazolidone), an aminophenol (e.g., N-methyl-p-aminophenol), a 1-phenyl-3-pyrazoline, etc., as an auxiliary developing agent for the dihydroxybenzene.

The dihydroxybenzene derivative developer is used at pH of at least 11.5, and preferably at least 12.

In order to keep pH of the developer at a constant value, an alkali agent is preferably used. Examples of the alkali agent are inorganic alkali agents such as sodium silicate, potassium silicate, sodium metasilicate, sodium hydroxide, potassium hydroxide, sodium triphosphate, sodium diphosphate, ammonium triphosphate, ammonium diphosphate, sodium bicarbonate, sodium borate, ammonium borate, ammonium hydroxide, etc., and organic amine compounds such as monomethylamine,dimethylamine, trimethylamine,-monoethylamine, diethylamine, triethylamine, monoisopropylamine, diisopropylamine, n-butylamine, monoethanolamine, diethanolamine, triethanolamine, monoisopropanolamine, diisopropanolamine, ethyleneimine, ethylenediamine, pyridine, etc., and they can be used singly or as a combination thereof.

The dihydroxybenzene derivative developer for use in this invention may contain an alkanolamine for obtaining a good image quality at high pH. An alkanolamine is a primary, secondary, or tertiary amine compound having at least one hydroxyalkyl group and examples thereof are ethanolamine, diethanolamine, triethanolamine, diisopropanolamine, N-methylethanolamine, N-aminoethylethanolamine, N,N-diethylethanolamine, N,N-dimethylethanolamine, N-methyldiethanolamine, N-ethyldiethanolamine, 3-aminopropanol, 3-diethylamino-1,2-propanediol,1-aminopropan-2-ol, 4-aminobutanol, 5-aminopentan-1-ol, 3,3'-iminopropanol, N-n-butyldiethanolamine, N-ethyl-2,2'-iminodiethanolamine, 2-amino-2-(hydroxymethyl)propane-1,3-diol, and 2-amino-2-methylpropane-1,3-diol. These alkanolamines may be used singly or as a combination thereof. Particularly preferred alkanolamines are tertiary alkanolamines.

In the dihydroxybenzene derivative developer for use in this invention, a sulfite can be used as a preservative. As the sulfite, there are sodium sulfite, potassium sulfite, lithium sulfite, ammonium sulfite, sodium bisulfite, potassium bisulfite, potassium metabisulfite, etc. The addition amount of the sulfite is preferably at least 0.1 mol per liter of the developer.

The dihydroxybenzene derivative developer may further contain, in addition to the foregoing components, a pH buffer (e.g., sodium metaborate, sodium triphosphate, and sodium carbonate), an inorganic antifoggant (e.g., sodium bromide and potassium bromide), and also, if necessary, a preservative, an alkali agent, a water-soluble acid (e.g. acetic and boric acid), an organic antifoggant (e.g., 1-phenyl-5- mercaptotetrazole and 5-methylbenzotriazole), an organic solvent (e.g., ethylene glycol, diethylene glycol, and methyl cellosolve), a toning agent, a surfactant, an anti-foaming agent, a hard water softener, etc.

The development processing temperature is selected in the range of from 18° C. to 50° C., and preferably from 20° C. to 40° C.

Next, the developer (2) containing an aminophenol derivative developing agent and a reductone compound or a salt thereof for use in this invention is explained. As the aminophenol derivative developing agent which is used in the developer for use in this invention, there are 4-aminophenol, 4-amino-3-methylphenol, 4-(N-methyl-)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, and the hydrochlorides and sulfates of these compounds. In particular, N-methyl-4-aminophenol sulfate (Metol) is preferred.

The addition amount of the developing agent is from 0.5 g to 10 g, and preferably from 1 g to 5 g per liter of the developer.

As the reductone compound which is used for the developer for use in this invention, endiol type compounds, enaminol type compounds, endiamine type compounds, thiol-enol type compounds, and enamine-thiol type compounds are generally known. Practical examples of these compounds are described in U.S. Pat. No. 2,688,549, JP-A-62-237443, etc. Synthesis methods of these reductone compounds are also well known and they are described in detail, e.g., in Danji Nomura and Hirohisa Oomura, *Chemistry of Reductone,* published by Uchida Rokakuho Shin-Sha.

Among these compounds, the particularly preferred reductone compounds are the compounds represented by formula (V):

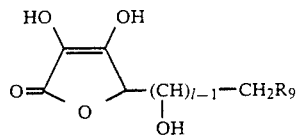

(V)

wherein $R_9$ represents a hydrogen atom or a hydroxy group and l represents an integer of from 1 to 4.

Then, specific examples of the particularly preferred reductone compound for use in this invention are illustrated below.

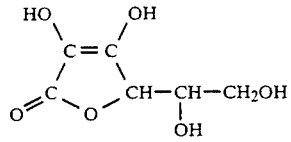

1-1

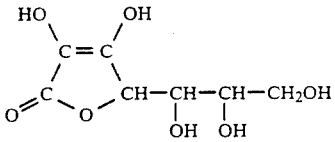

1-2

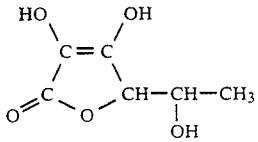

1-3

-continued 1-4

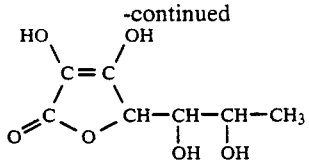

1-5

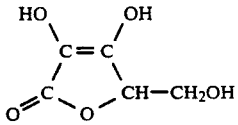

1-6

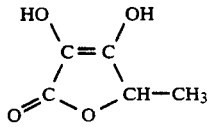

1-7

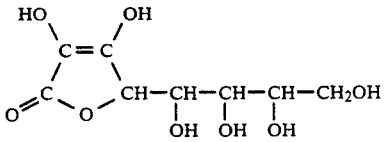

1-8

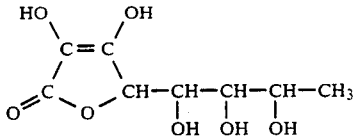

2-1

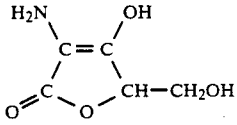

2-2

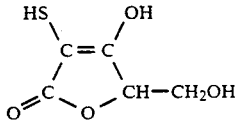

2-3

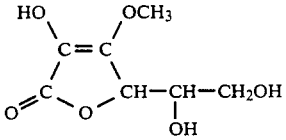

2-4

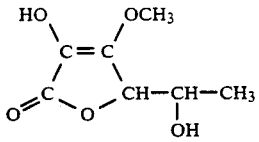

The reductone compounds for use in this invention can be used in the forms of the alkali metal salts thereof, such as the lithium salts, the sodium salts, the potassium salts, etc. It is preferable that the reductone compound is used in an amount of from 1 g to 50 g, and particularly from 5 g to 20 g per liter of the developer.

The developer (2) for use in this invention may further contains, in addition to the foregoing necessary components, a pH buffer (e.g., sodium metaborate, sodium triphosphate, and sodium carbonate), an inorganic antifoggant (e.g., sodium bromide and potassium bromide) and further, if necessary, may contain a preservative, an alkali agent, a water-soluble acid (e.g., acetic acid and boric acid), an organic antifoggant (e.g., 1-phenyl-5-mercaptotetrazole), an organic solvent (e.g., ethylene glycol, diethylene glycol, and methyl cellosolve), a toning agent, a surfactant, an anti-foaming agent, a hard water softener, etc.

As the preservative, sulfites can be used. As the sulfites for use in this invention, there are sodium sulfite, potassium sulfite, lithium sulfite, ammonium sulfite, sodium bisulfite, potassium bisulfite, potassium metabisulfite, etc. The addition amount of the sulfite is preferably at least 0.1 mol per liter of the developer.

The alkali agent is added to the developer for adjusting the pH of the developer at least 9, and particularly preferably from 10 to 11. As the alkali agent, an ordinary water-soluble inorganic alkali metal salt such as sodium hydroxide, potassium hydroxide, sodium carbonate, potassium carbonate, potassium triphosphate, etc., can be used.

The development processing temperature is selected in the range of from 18° C. to 50° C., and preferably from 20° C. to 40° C.

Then, the invention is described more practically by referring to the following examples but the invention is not limited to them in the scope of the invention.

EXAMPLE 1

By simultaneously adding an aqueous silver nitrate solution and an aqueous potassium bromide solution containing $3.0\times10^{-7}$ of sodium rhodium (III) hexabromide to an aqueous gelatin solution kept at 60° C. while keeping pAg at 7.0 over a period of 60 minutes, a monodispersed silver bromide emulsion composed of cubic crystal grains having a mean grain size of 0.20 μm was prepared. Then, after removing soluble salts from the emulsion by an ordinary method, $25\times10^{-5}$ mol of sodium thiosulfate per mol of silver halide was added to the emulsion and chemical ripening was carried out for 70 minutes at 60° C. The silver halide emulsion contained 80 g of gelatin per mol of silver halide.

After adding $12\times10^{-3}$ mol of 6-hydroxy-4-methyl-1,3,3*a*, 7-tetraazaindene and $3.5\times10^{-4}$ mol of 3,3'-dimethylthiazolinocarbocyanine methylsulfate per mol of silver halide to the silver halide emulsion, the emulsion was divided into ten parts and each of the quaternary ammonium salt polymers in this invention and Comparative Compounds 1, 2, and 3 shown below was added to each part of the silver halide emulsion as shown in Table 1 below.

Comparative Compound 1

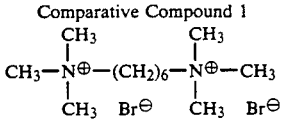

Comparative Compound 2

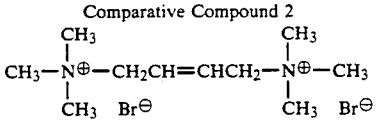

Comparative Compound 3

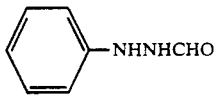

TABLE 1

| Test No. | Added Compound | Weight-Average Molecular Weight | Amount (g/mol Ag) |
|---|---|---|---|
| 1 | none | — | — |
| 2 | Comparative Compound 1 | — | 10.0 |
| 3 | Comparative Compound 2 | — | 10.0 |
| 4 | Comparative Compound 3 | — | 2.3 |
| 5 | P-7 | 15,000 | 8.0 |
| 6 | P-8 | 7,000 | 4.0 |
| 7 | P-9 | 22,000 | 4.0 |
| 8 | P-10 | 26,600 | 4.0 |
| 9 | P-17 | 4,000 | 4.5 |
| 10 | P-20 | 5,200 | 3.0 |

Test Nos. 1 to 4: Comparative Examples
Test Nos. 5 to 10: Examples of the Invention Each emulsion thus prepared was coated on a polyethylene terephthalate film base at a silver coverage of 40 mg/dm$^2$. Each emulsion layer was protected by a gelatin protective layer containing formaldehyde and dimethylolurea.

Each film sample thus prepared was exposed for 5 seconds to a tungsten light source of 2666K using an LB-200 filter through a step wedge having a step difference of 0.15 log E, developed using the developer having the following composition for 30 seconds at 38° C., and then stopped, fixed, washed and dried.

| Developer Composition: | |
|---|---|
| Metol | 2.0 g |
| Hydroquinone | 25.0 g |
| Sodium Sulfite | 56.0 g |
| Sodium Carbonate | 45.0 g |
| Sodium Bromide | 3.0 g |
| Diethylaminopropanediol | 15.0 g |
| 5-Methylbenzotriazole | 0.2 g |
| Ethylenediaminotetraacetic acid-Tetra-Sodium Salt | 1.2 g |
| 50% Sodium Hydroxide | 20.0 g |
| Water to make | 1 liter |
| pH | 12.2 |

The photographic characteristics thus obtained are shown in Table 2.

TABLE 2

| | Photographic Characteristics | | | |
|---|---|---|---|---|
| Test No. | Relative Sensitivity | Fog | Gamma | Pepper |
| 1 | 100 | 0.03 | 4.6 | A |
| 2 | 104 | 0.04 | 3.6 | A |
| 3 | 102 | 0.04 | 3.9 | A |
| 4 | 265 | 0.04 | 20.1 | D |
| 5 | 265 | 0.05 | 23.0 | A |
| 6 | 195 | 0.04 | 10.7 | A |
| 7 | 260 | 0.04 | 23.1 | A |
| 8 | 250 | 0.05 | 22.0 | A |
| 9 | 216 | 0.04 | 16.3 | A |
| 10 | 243 | 0.04 | 19.0 | A |

In Table 2 above, the relative sensitivity is the relative value of the reciprocal of the exposure amount for giving the density of 2.0 excluding fog with the sensitivity of Test No. 1 being defined as 100.

The gamma is shown by an average slope between the densities 0.5 and 2.0 each excluding fog.

The pepper susceptibility was evaluated in 5 ranks by observing the unexposed area of each film with a magnifying glass (Lupe), wherein A shows the best quality (substantially free from any pepper) and E shows the worst quality.

Ranks A and B are acceptable for practical use, rank C is a low quality but somewhat in an allowable range for practical use, and ranks D and E are unacceptable for practical use.

As is clear from the results shown in Table 2, it can be seen that Test Nos. 5 to 10 each using the quaternary ammonium salt polymer for use in this invention show a greatly increased sensitivity and at the same time show a greatly increased gamma to increase the contrast without the appearance of pepper. On the other hand, in Test No. 1 not using a quaternary ammonium salt compound and Test Nos. 2 and 3 each using the comparative compound having a low molecular weight, the sensitivity and gamma are poor. Further, in Test No. 4 using formylphenylhydrazine as the comparative compound (Comparative Compound 3), a high sensitivity and a high contrast are obtained but at the same time a large amount of pepper is observed.

EXAMPLE 2

By simultaneously adding an aqueous silver nitrate solution and an aqueous solution of a mixture of potassium bromide and sodium chloride (Br/Cl=30/70 by mol ratio) containing $1.5\times10^{-7}$ mol of sodium rhodium (III) hexachloride to an aqueous gelatin solution kept at 40° C. while keeping pAg at 7.2 over a period of 75 minutes, a monodispersed silver chlorobromide emulsion (AgCl 70 mol %) composed of cubic silver halide grains having a mean grain size of 0.28 μm was prepared.

After removing soluble salts from the emulsion by an ordinary method, $5\times10^{-5}$ mol of sodium thiosulfate per mol of silver halide was added to the emulsion and chemical ripening was carried out for 120 minutes at 52.2° C. The silver halide emulsion contained 80 g of gelatin per mol of silver halide. The emulsion was divided into eleven parts. Then, after adding to each of the emulsions $6\times10^{-3}$ mol of 6-hydroxy-4-methyl-1,3,3*a*,7-tetraazaindene per mol of silver halide and each of the quaternary ammonium salt polymers or copolymers for use in this invention as shown in Table 3 below, each emulsion was coated on a polyethylene terephthalate (PET) film base at a silver coverage of 40 mg/dm$^2$.

TABLE 3

| | Quaternary Ammonium Salt Polymer | | |
|---|---|---|---|
| Test No. | Compound No. | Weight-Average Molecular Weight | Amount (g/mol Ag) |
| 11 | None | — | — |
| 12 | P-1 | 26,600 | 2.0 |
| 13 | P-7 | 15,000 | 2.6 |
| 14 | P-8 | 7,000 | 4.1 |
| 15 | P-9 | 21,000 | 2.0 |
| 16 | P-16 | 2,300 | 2.3 |
| 17 | P-17 | 6,000 | 3.0 |
| 18 | P-22 | 17,800 | 2.6 |
| 19 | P-23 | 11,000 | 2.6 |
| 20 | P-24 | 12,300 | 2.5 |
| 21 | P-32 | 15,300 | 2.6 |

Test No. 11: Comparative Example
Test Nos. 12 to 21: Examples of the Invention

Each emulsion layer was protected by a gelatin protective layer containing formaldehyde and dimethylolurea as hardening agents to provide film sample Nos. 11 to 21.

Each of the film samples thus prepared was exposed for 5 seconds to a tungsten light source of 226K using an LB-200 filter through a step wedge having a step difference of 0.15 log E, developed with the developer having the following composition for 2 minutes at 30° C., and stopped, fixed, washed, and dried.

| Developer Composition: | |
|---|---|
| Metol | 2.5 g |
| Sodium Ascorbate (Sodium Salt of Reductone 1—1) | 10.0 g |
| Potassium Bromide | 1.0 g |
| Sodium Metaborate.Tetra-hydrate | 35.0 g |
| Water to make | 1.0 liter |
| pH | 10.8 |

The photographic characteristics obtained are shown in Table 4.

TABLE 4

| | Photographic Characteristics | | | |
|---|---|---|---|---|
| Test No. | Relative Sensitivity | Gamma | Fog | Pepper |
| 11 | 100 | 3.4 | 0.04 | — |
| 12 | 890 | 13.1 | 0.04 | A |
| 13 | 1050 | 14.6 | 0.05 | A |
| 14 | 920 | 14.0 | 0.06 | A |
| 15 | 977 | 13.7 | 0.05 | A |
| 16 | 790 | 12.4 | 0.04 | A |
| 17 | 1000 | 13.8 | 0.07 | A |
| 18 | 950 | 14.5 | 0.06 | A |
| 19 | 880 | 13.3 | 0.05 | A |
| 20 | 920 | 14.2 | 0.05 | A |
| 21 | 1050 | 15.1 | 0.05 | A |

In Table 4 above, the relative sensitivity is the relative value of the reciprocal of the exposure amount for giving the density of 3.0 excluding fog with the sensitivity of Test No. 11 being defined as 100.

The gamma is shown by an average slope between the densities 0.5 and 3.0 each excluding fog.

The pepper susceptibility was evaluated in 5 ranks by observing the unexposed area of each film with a magnifying glass (Lupe), wherein A shows the best quality (substantially free from any pepper) and E shows the worst quality.

Ranks A and B are acceptable for practical use, rank C is a low quality but somewhat in an allowable range for practical use, and ranks D and E are unacceptable for practical use.

As is clear from the results shown in Table 4, the samples of this invention each containing the quaternary ammonium salt polymer for use in this invention give good negative images having a high contrast and a high sensitivity without the appearance of pepper. On the other hand, in the case of the comparative example containing no quaternary ammonium salt polymer, the negative image obtained has a soft gradation.

EXAMPLE 3

By simultaneously adding an aqueous silver nitrate solution and an aqueous solution of a mixture of potassium bromide and sodium chloride (Br/Cl=30/70 by mol ratio) containing $1.5\times10^{-7}$ mol of sodium rhodium (III) hexachloride to an aqueous gelatin solution kept at 40° C. while keeping pAg at 7.2 over a period of 75 minutes, a monodispersed silver chlorobromide emulsion composed of cubic grains having a mean grain size of 0.28 μm was prepared.

After removing soluble salts by an ordinary method, $5\times10^{-5}$ mol of sodium thiosulfate per mol of silver was added to the silver halide emulsion and chemical ripening was carried out for 100 minutes at 50.0° C.

The silver halide emulsion contained 80 g of gelatin per mol of silver halide. After adding $6\times10^{-3}$ mol of 6-hydroxy-4-methyl-1,3,3*a*,7-tetraazaindene and 2.6 g of the quaternary ammonium salt polymer (P-7) per mol of silver halide to the silver halide emulsion thus prepared, the emulsion was coated on a polyethylene terephthalate (PET) film base at a silver coverage of 40 mg/dm$^2$. The emulsion layer formed was protected by a gelatin protective layer containing formaldehyde and dimethylolurea as hardening agents.

The film sample prepared as described above was exposed as in Example 1, developed using each of developers 1 to 8 shown in Table 5 in each case for 2 minutes at 30° C., and then, stopped fixed, washed, and dried.

TABLE 5

| | Developer No. (g/liter) | | | | | | | |
|---|---|---|---|---|---|---|---|---|
| Developer Composition | 1 | 2 | 3 | 4 | 5 | 6 | 7 | 8 |
| Metol | 2.5 | — | — | 2.5 | 10.0 | — | 2.5 | 2.5 |
| p-Aminophenol | — | — | — | — | — | 2.5 | — | — |
| Phenidone | — | — | 2.5 | — | — | — | — | — |
| Reductone Sodium Salt | — | (1—1) | (1—1) | (1—1) | (1—1) | (1—1) | (1—1) | (1-3) |
| | — | 10.0 | 10.0 | 10.0 | 10.0 | 10.0 | 10.0 | 10.0 |
| Potassium Bromide | 1.0 | 1.0 | 1.0 | 1.0 | 1.0 | 1.0 | 1.0 | 1.0 |
| Sodium Metaborate.Tetrahydrate | 35.0 | 35.0 | 35.0 | 35.0 | 35.0 | 35.0 | 35.0 | 35.0 |
| Sodium Sulfite | — | — | — | — | — | — | 5.0 | — |
| pH* | 10.8 | 10.8 | 10.8 | 10.8 | 10.8 | 10.8 | 10.8 | 10.8 |

(*)Adjusted with sodium hydroxide

The photographic characteristics of each sample thus prepared were evaluated as in Example 1 and the results obtained are shown in Table 6.

TABLE 6

| | Photographic Characteristics | | | |
|---|---|---|---|---|
| Developer No. | Relative Sensitivity | Gamma | Fog | Pepper |
| 1 | 10 | 3.4 | 0.04 | — |
| 2 | No image formed. | | | |
| 3 | 12 | 3.6 | 0.05 | — |
| 4 | 100 | 14.6 | 0.07 | A |
| 5 | 107 | 15.1 | 0.07 | A |
| 6 | 92 | 12.8 | 0.06 | A |
| 7 | 100 | 13.5 | 0.07 | A |
| 8 | 93 | 13.0 | 0.07 | A |

Developer Nos. 1 to 3: Comparative Examples
Developer Nos. 4 to 8: Examples of the Invention The relative sensitivity in Table 6 is shown as a relative value with the sensitivity in Developer No. 4 (this invention) being defined as 100.

As is clear from the results in Table 6, it can be seen that in the case of using developers No. 4 to No. 8 according to this invention, images having a very high contrast having gamma over 10 and having a high sensitivity without the appearance of pepper are obtained, but in the cases of the comparative examples which do not meet the factors according to the present invention, high contrast images can not be obtained.

While the invention has been described in detail and with reference to specific embodiments thereof, it will be apparent to one skilled in the art that various changes and modifications can be made therein without departing from the spirit and scope thereof.

What is claimed is:

1. A process for forming a high-contrast negative image comprising:

a) providing a photographic material comprising one or more hydrophilic colloidal layers on a substrate, wherein at least one of the hydrophilic colloidal layers is a negative working silver halide emulsion layer comprising silver halide and a water soluble polymer or copolymer including at least one repeating unit selected from the group consisting of formulas (I) to (IV):

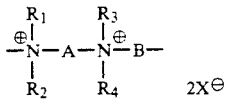

(I)

wherein A represents an alkylene group having from 1 to 6 carbon atoms, $-CH_2-CH=CH-CH_2-$, or $-CH_2-C\equiv C-CH_2-$, B represents an alkylene group having form 1 to 6 carbon atoms, a p-xylylene group, $-CH_2-CH=CH-CH_2-$, or $-CH_2-C\equiv C-CH_2-$; $R_1$, $R_2$, $R_3$, and $R_4$, each independently represents a lower alkyl group having from 1 to 4 carbon atoms; and $X^-$ represents an anion,

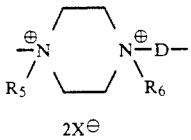

(II)

wherein D represents an alkylene group from 1 to 6 carbon atoms, $-CH_2-CH=CH-CH_2-$, or $-CH_2-C\equiv C-CH_2-$, $R_5$ and $R_6$ each independently represents a lower alkyl group having from 1 to 4 carbon atoms, provided that $R_5$ and $R_6$ may be combined with each other to form an ethylene group and $X^-$ represents an anion,

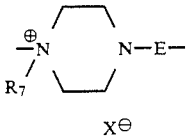

(III)

wherein E represents an alkylene group having from 1 to 6 carbon atoms, $-CH_2-CH=CH-CH_2-$, or $-CH_2-C\equiv C-CH_2-$, $R_7$ represents a lower alkyl group having from 1 to 4 carbon atoms; and $X^-$ represents an anion,

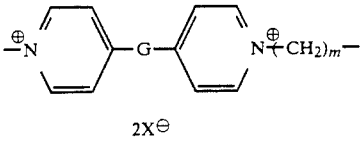

(IV)

wherein G represents an alkylene group having from 1 to 8 carbon atoms; $R_8$ represents a hydrogen atom or a methyl group; m represents an integer of from 1 to 4; n represents an integer of from 1 to 12; and $X^-$ represents an anion;

b) exposing the photographic material; and thereafter c) developing the exposed photographic material with an aqueous alkaline developer including a dihydroxybenzene derivative developing agent at a pH of at least 11.5

2. A process for forming a high-contrast negative image as defined in claim 1, wherein the dihydroxybenzene derivative developing agent of step (c) is in an amount of 5 to 100 g per liter of developer.

3. A process for forming a high-contrast negative image as defined in claim 1, wherein step (c) further comprises developing the exposed photographic material at a temperature of 18° C. to 50° C.

4. A process for forming a high-contrast negative image comprising:

a) providing a photographic material comprising one or more hydrophilic colloidal layers on a substrate, wherein at least one of the hydrophilic colloidal layers is a negative working silver halide emulsion layer comprising silver halide and a water soluble polymer or copolymer including at least one repeating unit selected from the group consisting of formulas (I) to (IV):

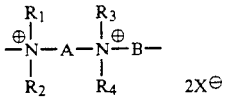

(I)

wherein A represents an alkylene group having from 1 to 6 carbon atoms, $-CH_2-CH=CH-CH_2-$, or $-CH_2-C\equiv C-CH_2-$, B represents an alkylene group having from 1 to 6 carbon atoms, a p-xylylene group, $-CH_2-CH=CH-CH_2-$, or $-CH_2-C\equiv C-CH_2-$; $R_1$, $R_2$, $R_3$, and $R_4$, each independently represents a lower alkyl group having from 1 to 4 carbon atoms; and $X^-$ represents an anion,

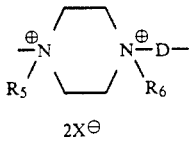

(II)

wherein D represents an alkylene group from 1 to 6 carbon atoms, $-CH_2-CH=CH-CH_2-$, or $-CH_2-C\equiv C-CH_2-$, $R_5$ and $R_6$ each independently represents a lower alkyl group having from 1 to 4 carbon atoms, provided that $R_5$ and $R_6$ may be combined with each other to form an ethylene group and $X^-$ represents an anion, (III)

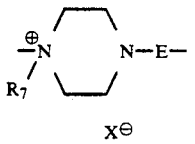

wherein E represents an alkylene group having from 1 to 6 carbon atoms, $-CH_2-CH=CH-CH_2-$, or $-CH_2-C\equiv C-CH_2-$, $R_7$ represents a lower alkyl group having from 1 to 4 carbon atoms; and $X^-$ represents an anion, (IV)

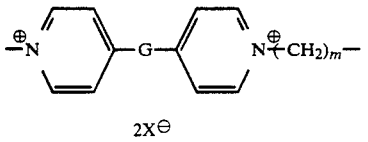

$$-O\left(CH(R_8)-CH_2O\right)_n\left(CH_2\right)_m-$$

wherein G represents an alkylene group having from 1 to 8 carbon atoms; $R_8$ represents a hydrogen atom or a methyl group; m represents an integer of from 1 to 4; n represents an integer of from 1 to 12; and $X^-$ represents an anion;

b) exposing the photographic material; and thereafter c) developing the exposed photographic material with an aqueous alkaline developer including a dihydroxybenzene derivative developing agent with a reductone compound.

5. A process for forming a high-contrast negative image as defined in claim 4, wherein the aminophenol derivative developing agent with a reductone compound of step (c) is in an amount of 0.5 to 10 g of an aminophenol derivative developing agent and 1 to 50 g of a reductone compound per liter of developer.

6. A process for forming a high-contrast negative image as defined in claim 4, wherein step (c) is at a pH of at least 9.

7. A process for forming a high-contrast negative image as defined in claim 4, wherein step (c) further comprises developing the exposed photographic material at a temperature of 18° C. to 50° C.

8. The process according to claim 4, wherein said aqueous alkaline developer contains an aminophenol derivative developing agent and a reductone compound represented by formula (V) or a salt thereof and has a pH of at least 9 and lower than 11.0:

(V)

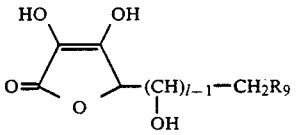

wherein $R_9$ represents a hydrogen atom or a hydroxy group and l represents an integer of from 1 to 4.

* * * * *